US005607377A

United States Patent [19]

Wilkinson

[11] Patent Number: 5,607,377

[45] Date of Patent: Mar. 4, 1997

[54] REBOUNDER AND PUNCHING BAG-BOXING FITNESS DEVICE

[76] Inventor: William T. Wilkinson, P.O. Box 572, Crownsville, Md. 21032-0572

[21] Appl. No.: 239,599

[22] Filed: May 9, 1994

[51] Int. Cl.[6] ..... A63B 71/02

[52] U.S. Cl. ..... 482/83; 482/87; 482/27; 482/30

[58] Field of Search ..... 482/29, 30, 87, 482/89, 27, 52, 83

[56] References Cited

U.S. PATENT DOCUMENTS

| | | | |
|---|---|---|---|
| 2,890,049 | 6/1959 | Lewis | 482/87 |
| 3,411,497 | 11/1968 | Rickey et al. | 482/87 |
| 3,501,141 | 3/1970 | Nissen et al. | 482/29 |
| 3,837,643 | 9/1974 | Lee | 482/29 |
| 4,284,271 | 8/1981 | Pettit et al. | 482/27 |
| 4,462,599 | 7/1984 | Brown | 482/87 |
| 4,477,083 | 10/1984 | Sowards | 482/29 |
| 4,557,478 | 12/1985 | Leving | 482/89 |
| 4,598,905 | 7/1986 | Vrana | 482/27 |
| 5,129,872 | 7/1992 | Dalton | 482/52 |

FOREIGN PATENT DOCUMENTS

| | | | |
|---|---|---|---|
| 1274573 | 9/1961 | France | 482/87 |
| 0432638 | 8/1926 | Germany | 482/87 |
| 2535405 | of 1977 | Germany | 482/87 |

*Primary Examiner*—Jerome Donnelly
*Attorney, Agent, or Firm*—Connolly & Hutz

[57] ABSTRACT

The device according to this invention combines two popular exercises which are rebounding, in which a user uses a trampoline or a spring board and boxing in which a user uses a punching bag and/or speed bag. In addition, the invention is drawn to a method of exercising comprising using the inventive device that comprises a combination of a rebounder and punching bag.

12 Claims, 5 Drawing Sheets

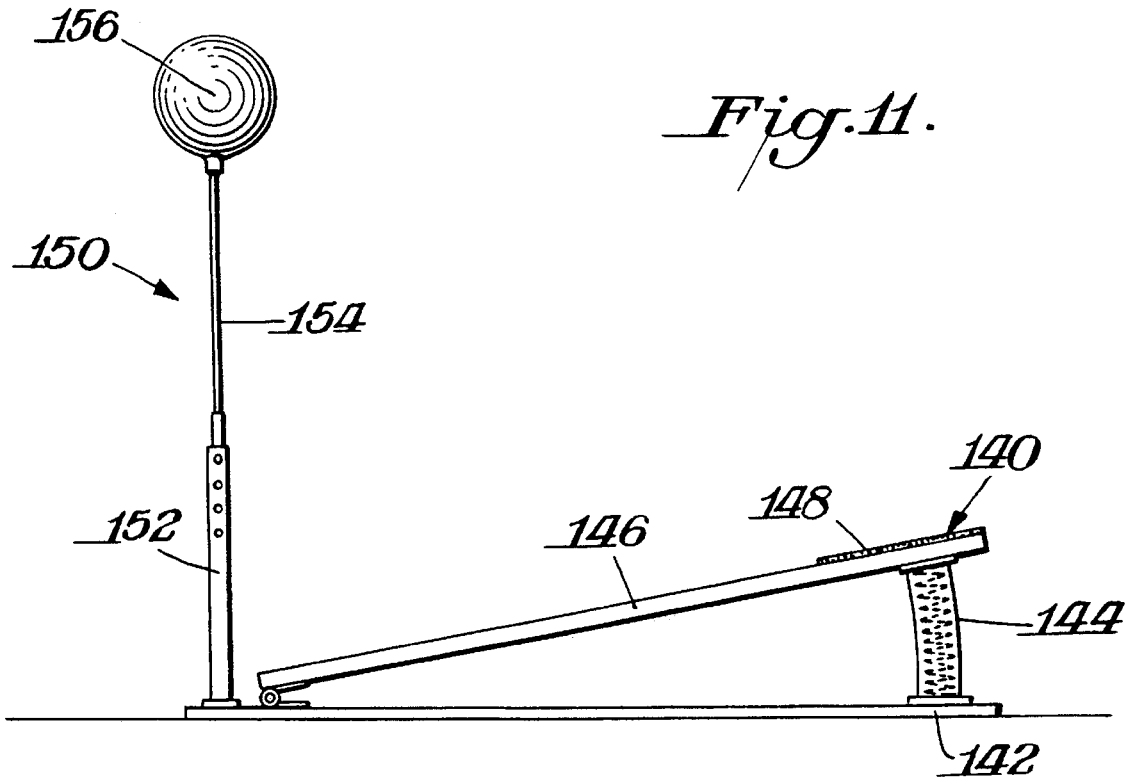
Fig. 11.
Fig. 10.
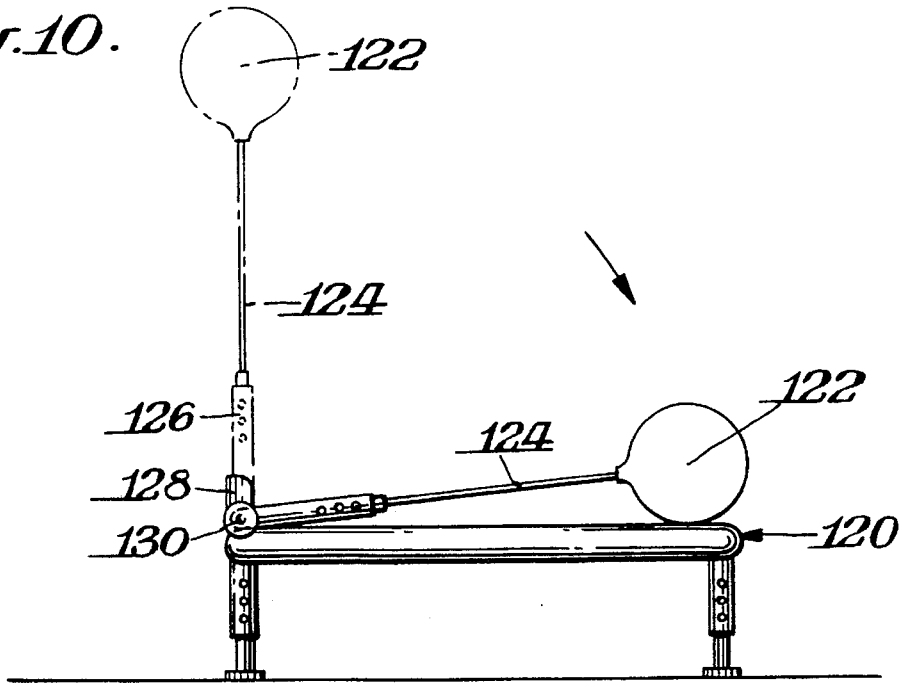

REBOUNDER AND PUNCHING BAG-BOXING FITNESS DEVICE

BACKGROUND OF THE INVENTION

There are many types of exercising equipment available in today's market place. Most of the exercise devices, however, only work one area of a user's body. They either work the lower area, which would be the legs or the upper area, which would be the chest and arms. Today two of the most popular exercises are rebounding in which a user uses a rebounding device such as a trampoline or spring board and works the lower body and the other is boxing whereby the user uses a punching a bag or speed bag. However, it was not known in the prior art to combine these two exercises on one device.

SUMMARY OF THE INVENTION

It is an object of this invention to provide a simple exercising device that gives a total body exercise (i.e. using both the arms and legs).

It is another object of this invention to provide an inexpensive exercise device.

A still further object of the invention is to provide a light-weight easily transportable and capable of being folded down to a travel-size exercise device that can be transported anywhere.

Another object of this invention is to provide an exercise device that can be used by the whole family no matter their ages.

A still further object of this invention is drawn to a method of achieving total body times workout by using the exercise device according to this invention.

This invention combines a punching and/or speed bag or any kind of bag, such as a heavy bag with a rebounding device such as a trampoline, preferably mini-trampoline or a spring/rebounding board, to create a unique dual-action fitness exercise device. The punching bag could also be a "Bozo" or knockdown bag that usually sits on the floor.

BRIEF OF DESCRIPTION OF THE DRAWINGS

FIG. 10 illustrates a side elevational view of a further embodiment of this invention.

FIG. 11 illustrates a side elevational view of a further embodiment of this invention.

DESCRIPTION OF THE INVENTION

The device according to this invention combines two popular exercises which are rebounding, in which a user uses a rebounding device such as, but not limited to a trampoline or a spring board, and boxing in which a user uses a punching bag such as, but not limited to a speed bag, heavy bag, or a knockdown bag typically referred to as a "Bozo" bag. In addition, the invention is drawn to a method of exercising comprising using the inventive device that comprises a combination of a rebounder and punching bag.

Figure 3:
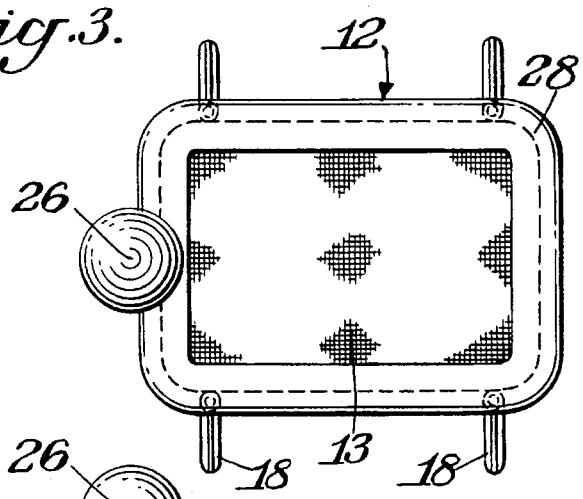
FIG. 3 illustrates the top plane view of FIGS. 1 and 2.
Figure 1:
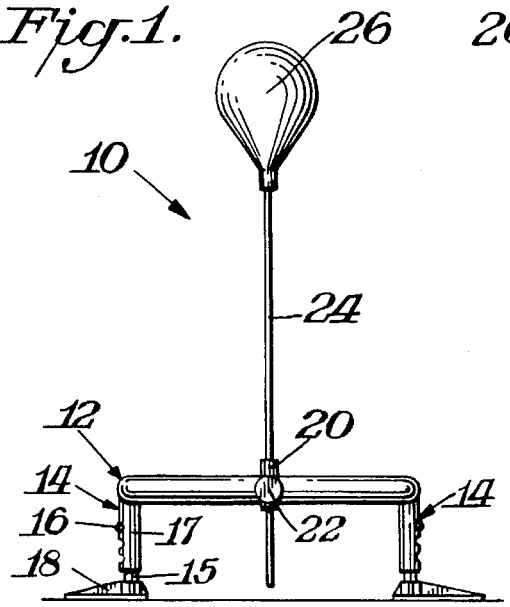
FIG. 1 illustrates an end elevational view of a combination punching bag and trampoline device according to this invention.
Figure 2:
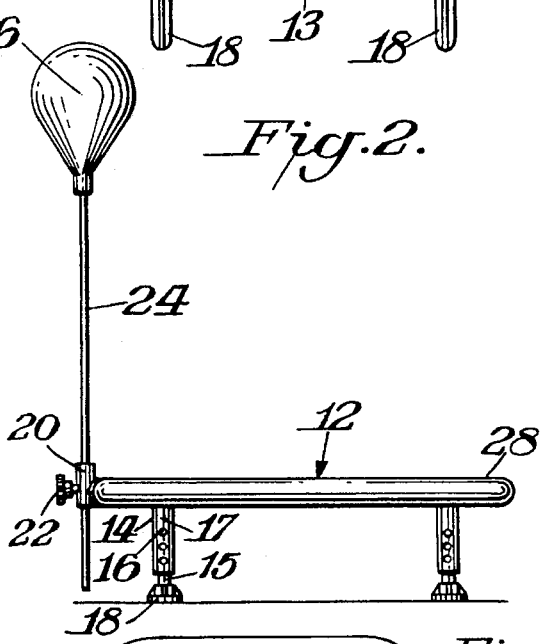
FIG. 2 illustrates the side elevational view of FIG. 1.

FIG. 1 is an end elevational view of the inventive device according to this invention. The device 10 consists of a rebounder 12 which can be, but is not limited to a trampoline, mini-trampoline or spring board having a rebounding surface 13. FIGS. 1 through 3 illustrate the rebounder 12 is a mini-trampoline. The trampoline 12 can be of any shape such as, but not limited to, circular, semi-circular, a square or rectangular. The rebounding device 12 would have legs 14 that could be adjustable. The legs 14 can be made of a tubular material. The legs 14 could have an inner shaft 15 and an outer shaft 17. The inner shaft 15 would have a smaller diameter than the outer shaft 17. The inner shaft 15 would be capable of sliding inside the outer shaft 17. There can be a series of aligned holes in the outer shaft 17. The inner shaft 15 could have a locking device such as a spring pin 16 that can fit inside the holes of the outer shaft 17 thereby adjusting the legs 14 to the desired height. The spring pin 16 could be attached to the inner shaft 15. The legs 14 could also have feet 18 at the bottom of the legs. The feet 18 could thereby add stability to the trampoline 12. The feet 18 could be made of any material such as plastic or rubber and would preferably have a non-slip surface. The feet 18 also could be made such that they can swivel.

The trampoline 12 could also have a sleeve 20 with a locking means 22 mounted to said trampoline 12. The sleeve 20 can be made of any durable material such as, but not limited to, a metal such as aluminum, stainless steel or steel or plastic such as polyvinylchloride "PVC". Mounted in the sleeve 20 could be reflex arm 24. The reflex arm 24 could be made of any material. Preferably the reflex arm 24 could be made of a strong durable flexible material such as but not limited to a plastic such as PVC or a metal such as aluminum, steel or stainless steel. It would be preferably cylindrical in shape, however it could be rectangular or square or, in fact, triangular. The reflex arm 24 would be adjustable by the locking means 22. The locking means 22 could be a hand screw whereby the reflex arm 24 could be adjusted vertically and the locking screw 22 can be tightened to lock the reflex arm 24 into the desired position. On the top of the reflex arm 24 could be attached a commercially available punching bag 26. The punching bag 26 can be adjustable or mono-adjustable as to height. The punching bag 26 can be adjustable as to the direction, such as back-and-forth and side-to-side. The sleeve 20 can be mounted at any position or moved around at any location on the top of the trampoline frame. The trampoline 12 could be padded 28 as shown in FIG. 2. The padding 28 could be placed on the top of the trampoline frame. The padding 28 would be able to prevent any injury if the user jumped or fell on the frame instead of the trampoline surface 13. The padding 28 could be made of a soft, resilient material such as, but not limited to a foam or a rubber.

Figure 4:
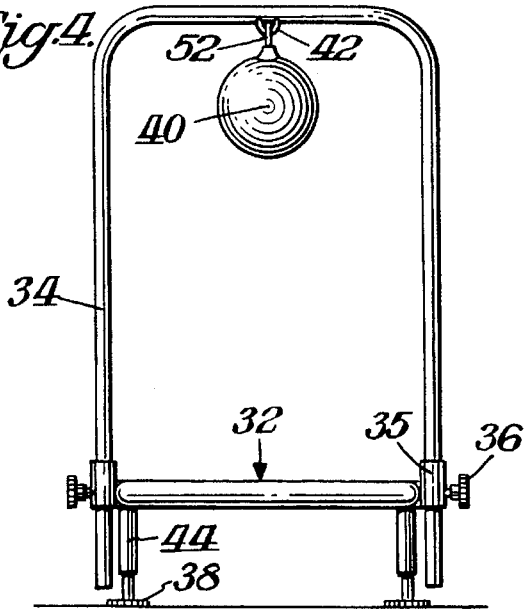
FIG. 4 illustrates an end elevational view of a further embodiment of this invention.

FIG. 4 shows another embodiment according to this invention. FIG. 4, illustrates an end elevational view of a combination punching bag 40 and rebounding device 32. The rebounding device 32 could be connected to a frame 34. The frame 34 could be made of any durable material such as, but not limited to, a metal such as aluminum or steel or a plastic such as PVC. The frame 34 could be in an inverted U-shape. The frame 34 could be adjustable in height by a locking means 36. The locking means 36 could be hand screw as shown in FIG. 4 or the frame 24 could be adjustable the same as described in FIG. 1 for the legs 14 with an inner shaft 15 and an outer shaft 17. The inner shaft can fit inside the outer shaft and the frame could be adjusted to the desired height by moving the frame in an up or down direction. There could be a series of aligned holes in the frame 34. The frame 34 could be adjusted by moving the frame in an up or down direction to the desired height. The hand screws 36 could be tightened into the holes to the desired height. Also mounted to the frame 34 could be a punching bag 40. The punching bag 40 could be any available commercial punching bag. The punching bag 40 could be attached to one end of a cord 52 The other end of the cord 52 could be attached to a fastening means 42 such as, but not limited to a commercial ring such as a D-shaped ring which is mounted to the frame 34. The D-ring 42 would allow the punching bag 40 to swivel. The cord 52 can be made of any material, but preferably it is elastic. The length of the cord 52 could be adjusted to the desired height. The legs 44 of the rebounder 32 could be adjustable in a similar manner as described in FIGS. 1 through 3. FIG. 4 shows feet 38 at the bottom of the legs 44. The feet 38 could be padded on the side that is in contact with the surface of the ground in order to prevent slippage of the inventive device. The feet 38 could be made of a non-slip material such as, but not limited to rubber.

Figure 5:
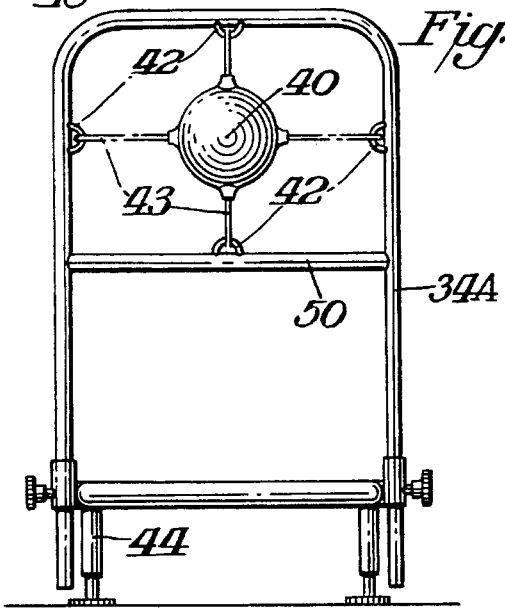
FIG. 5 illustrates an end elevational view of a further embodiment of this invention.

FIG. 5 shows a different embodiment according to this invention. The embodiment of FIG. 5 is very similar to that of FIG. 4. The inverted U-shaped frame 34A would be connected to a rebounding device 32. The rebounding device 32 is shown as a trampoline in FIG. 5. The legs 44 could be adjustable in vertical direction as described in FIGS. 1–3. The feet 38 could be attached to the bottom of the legs 44. The feet 38 are described in more detail in FIG. 4. The frame 34A could be adjusted to the desired height by using the locking means 36 as described in FIG. 4. The locking means 36 is described above under the description of FIG. 4. The frame 34A could also have a crossbar 50 for added support and to keep the punching bag 40 in place. There could be a series of D-rings 42A mounted to at least one location, preferably at least two locations and more preferably at least four locations in the frame 34A and the crossbar 50. The punching bag 40 could have cords 52 preferably made of an elastic material, connected to each of the D-rings 42.

Figure 6:
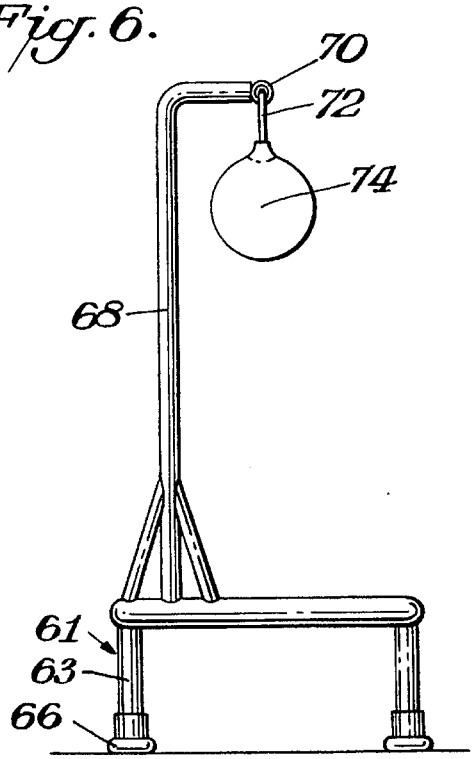
FIG. 6 illustrates a front elevational view of a further embodiment of this invention.

FIG. 6 illustrates a front elevational view of a combination over-head mounted punching bag and trampoline device according to this invention. The embodiment shown in FIG. 6 is not adjustable. FIG. 6 shows a rebounding device 61 which could be a trampoline. The trampoline 61 could be non-adjustable in height. The trampoline 61 could have at least two and preferably four legs 63. At the bottom of the legs 63 could be a non-slip foot 66. The non-slip foot 66 could be the same as item number 18 in FIGS. 1–3 or item 38 as described in FIGS. 4 and 5. Mounted to the trampoline 61 could be support column 68. The support column 68 could have a horizontal arm extending from the support column 68. The horizontal arm may be part of the fixed support column 68 or it can be attached to the top of the support column 68. At the end of the horizontal support arm could be a fastening means 70 such as, but not limited to an eyelet attached to the horizontal arm. The eyelet 70 could have a cord 72, preferably made from elastic, attached to it. One end of the cord 72 could be attached to a punching bag 74 and the other end of the cord 72 could be attached to the eyelet 70. The embodiment shown in of FIG. 6 would not be adjustable however it could be made adjustable in the manner described in the FIGS. 1–5 above.

Figure 7:
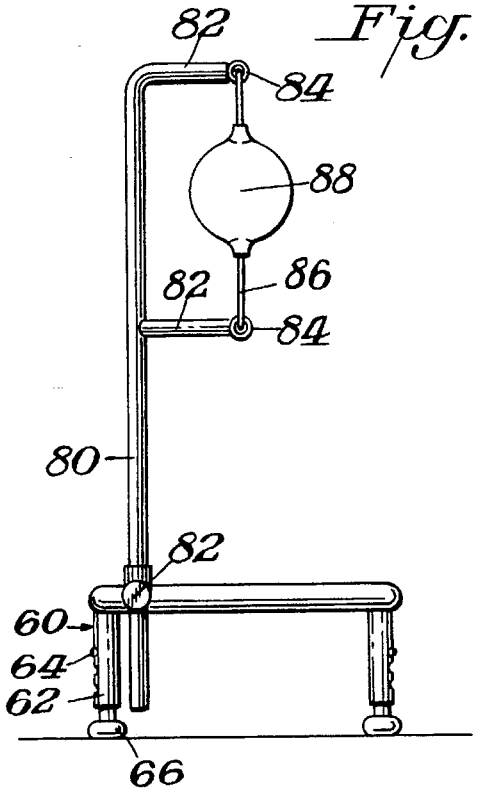
FIG. 7 illustrates a from elevational view of a further embodiment of this invention.

The embodiment of FIG. 7 is very similar to the embodiment of FIG. 6. The embodiment shown in of FIG. 7 is adjustable. The trampoline 60 would have adjustable legs 62. The legs 62 would be adjusted by moving the legs 62 in an up and down direction to the desired height. There could be locking mechanism 64. The locking mechanism 64 can consist of a spring pin. The legs 62 could be made of a telescoping inner and outer shaft as described in FIGS. 1–3. The inner shaft could have a pin 64 mounted to the inner shaft. The outer shaft could have a series of aligned holes whereby the pin 64 would fit into one of the holes and thereby lock the leg 62 in position. At the bottom of the legs 62 would be a no-slip foot 66 which could be the same as described in FIG. 6. A support column 80 would be connected to the trampoline 60. The support column 80 could be adjustable in height. The support column 80 could be locked into place by a locking mechanism 82. The locking mechanism 82 shown in FIG. 7 is a hand screw locking mechanism. The support column 80 could have a series of aligned holes. The locking mechanism 82 could fit into one of the holes and would lock into position thereby lock the support column 80 to the desired position. The support column 80 could also have at least one, and preferably at least two horizontal arms 82. This arm 82 can be part of the support column 80 or a separate attachment to the support column 80. A fastening means such as eyelets 84 could be connected to the support arms 82. There could be at least one, and preferably at least two cords 86 could have one end connected to a fastening means 84. The eyelet 84 could be attached to the end of the support arms 82. The cords 86 could also have the other end connected to a punching bag 88. The cords 86 could be tied to the eyelets 84 so that the tension of the cords 86 could be changed to the desired tension. The position of the punching bag 88 can be changed depending on how the cords 86 are tied. The punching bag 88 can be lowered or raised.

Figure 8:
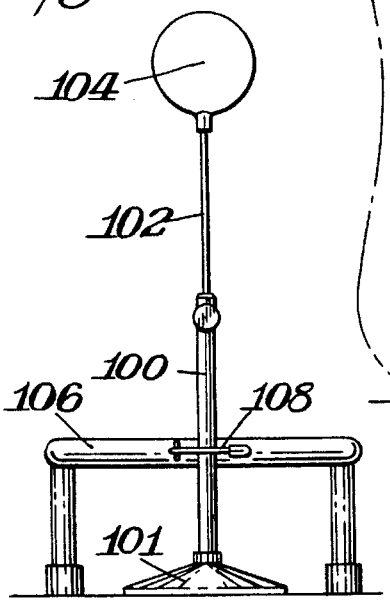
FIG. 8 illustrates a front elevational view of a further embodiment of this invention.

FIG. 8 shows a front elevational view of a combination stand mounted punching bag and rebounding device. A rebounding device 106 could be non-adjustable as shown in FIGS. 6 and 8 or it could be adjustable as shown in FIGS. 1, 2, 4, 5, and 7. A support column 100 could be connected to the trampoline 106. The support column 100 could be connected by any fastening means 108 such as by retainer cord or snap as shown in FIG. 8. The bottom of the support column 100 could be connected to a base 101. The base 101 could add additional stability to the punching bag device. A reflex arm 102 would fit inside the support column 100. The flex arm 42 would have a smaller diameter than the support column 100. There could be locking means 107 which could be a hand screw as described as item number 22 in FIGS. 1–3 or item number 36 in FIGS. 1 and 5. The reflex arm 102 could have a series of aligned holes and can be adjusted to the desired height. The locking means 107 can be a screw or a pin which could lock into lock one of the holes in the reflex arm 102 and thereby lock it into position. The punching bag 107 could be mounted to the top of the reflex arm 102. The punching bag could be any conventional punching bag.

Figure 9:
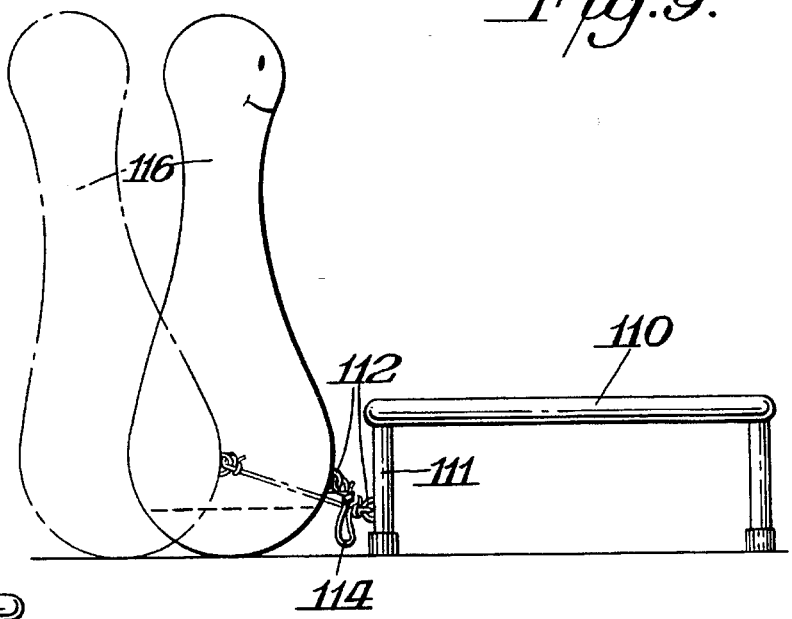
FIG. 9 illustrates a side elevational view of a further embodiment of this invention.

FIG. 9 shows a side elevational view of a combination pop-up punching bag and rebounding device. The rebounding device 110 could be any rebound device such as the trampolines described above in FIGS. 1 through 8. It could be adjustable or non-adjustable. A fastening means such as, but not limited to a commercially available ring 112 could be connected to one of the legs of the trampoline 110. There could be a cord 114 tied to the ring 112. The cord 114 could be of any length and made of any material., preferably an elastic material. The cord 114 is preferably, not too long in length in order to prevent the bag 116 from moving too far away from the trampoline 110 after being hit by the user. The other end of the cord 114 could be tied to a pop-up punching bag 116. The pop-up punching bag 116 could be any commercially available pop-up punching bag such as the Bozo® bags. The pop-up punching bag 116 would have a weighted bottom and could be filled up with air. The weighted bottom would cause the punching bag to pop up back to the original position after it is hit. The pop-up punching bag 116 could have a fastening means such as, but not limited to a D-ring 112 connected to it. On end of the cord 114 is tied to the leg of the ring 112 on the trampoline 110 and the other end of the cord 114 is tied to the ring 112 on the pup-up punching bag 116. The legs shown 111 are not adjustable, however, the legs could be adjustable as discussed above.

FIG. 10 shows a side-elevational view of a combination punching bag that is foldable to a stored position and a trampoline. The trampoline 120 could be an adjustable trampoline such as is shown in FIGS. 1 through 5 and 7 and 10. It could also be a nonadjustable trampoline as shown in FIGS. 6, 8 and 9 however, preferably it is an adjustable trampoline. The punching bag 122 could be mounted to a reflex arm 124. The reflex arm 124 could be connected to a support column 126. The support column 126 could have a series of aligned holes. The support column 126 could have an inner and outer tube. The inner tube could have a pin mounted on the outside of the inner tube such that the pin could fit into the series of aligned holes of the outer tube. The pin could be depressed which would allow the inner tube to be moved in an up or down direction, thereby changing the height of the punching bag. The inner tube would lock into a position on the outer tube when the pin falls into one of the aligned holes. There could be a semi-circular sleeve 128 connected to the support column 126 and the trampoline 120. The semi-circular sleeve 128 would allow the punching bag to be locked into an upright position, so that the punching bag 122 can be hit by a user. A ball 130 could be connected to the bottom of the support column 126 and could allow the support column 126 to be raised to an upright position or lowered to a storage position when the user is finished with the device the support column 126 can be folded down and the device ready to store. The legs of the trampoline could be on pivots such that they would also fold in thereby making the device very compact and easy to store. The legs could be adjustable as described in FIGS. 1–3 above.

FIG. 11 shows a side elevational view of a combination punching bag and rebounding device. The rebound device shown in FIG. 11 is a spring board 140. The spring 140 could consist of a base 142 and a spring 144. At one end of the base 142 would be a spring 144 connected to the base 142. The other end of the spring 144 could connect to a platform 146. On top of the platform 146 could be a padded surface 148 for the user's feet. The user could jump on the padded surface 148. At the other end of the base 142 opposite the spring 144, could be a hinge pivot connecting the opposite end of the support surface 142 with the spring board 146. Mounted to the very end of the support surface 142 could be the punching bag assembly 150. The punching bag assembly 150 could consist of a support column 152 and a reflex arm 154 and a punching ball 156. The support column 152 would be mounted on the support surface 142. The reflex arm 154 would have a smaller diameter than the support column 152. The reflex arm 154 would fit inside the support column 152. It would be adjustable by any conventional manner such as a spring pin adjustment as described above. The punching bag 156 would be mounted to the top of the reflex arm 154. The punching bag 156 could be any conventional punching bag as described above.

Figure 12:
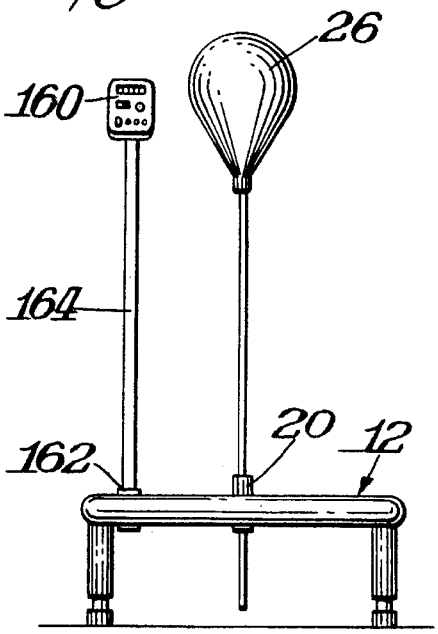
FIG. 12 illustrates a rear elevational view of a further embodiment of this invention.

FIG. 12 shows a rear elevational view of the combination punching bag and rebounding device with a programmable workout display. The rebound device shown in FIG. 12 is a trampoline 12. The punching bag 26 is attached to the trampoline 12 by a sleeve 20. There could be a mounting bracket 162 attached to the trampoline 12. A support arm 164 can be connected to the mounting bracket 162. A programmable workout display 160 can be connected to the support arm 164. The support arm 164 can be adjustable in height in the same method as was discussed above with the legs of the trampoline. The workout display 160 could contain a clock stating the time, a pulse meter, a stopwatch, a count-down timer, in fact, the programmable workout display could also have a radio and/or cassette player and/or compact disc player attached to it so that the user can play music while working out. This programmable workout display 160 could be attached to any of the inventive devices shown.

Figure 13:
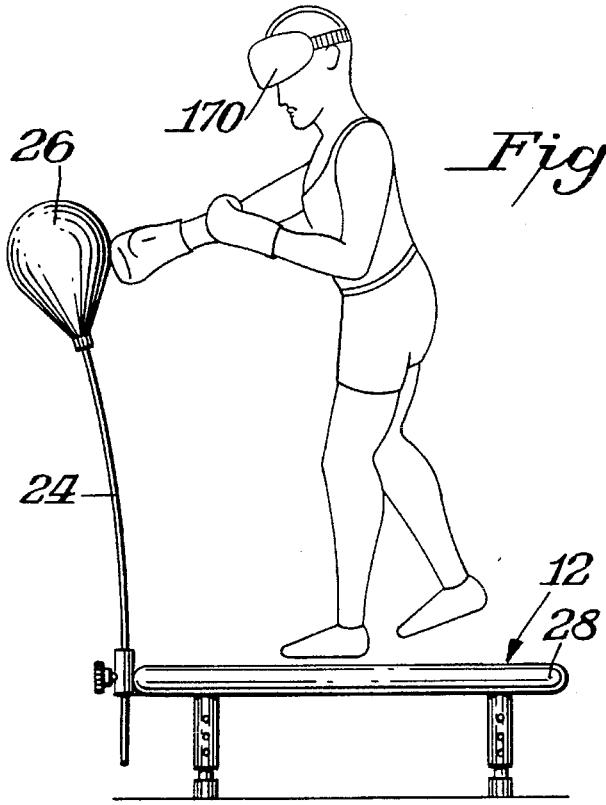
FIG. 13 illustrates a side elevational view of a further embodiment of this invention.

FIG. 13 shows a side elevational view of a user wearing a virtual reality device, which is a commercially known and available interactive technology device. The user is using this device in combination with the punching bag and rebounding device. Virtual reality allows the user to interact with the inventive exercise device, by the use of software containing the desired programs in virtual reality. The user can be put into any setting such as fighting a professional boxer. The user could wear equipment 170 which could allow the user to be connected to virtual reality and the user could step on or jump on the rebounding device 12 which in FIG. 13 is shown to be a trampoline. The user could hit the punching bag 26 with his hands or gloves. The punching bag 26 can be a punching bag, a heaving bag, a Bozo or knockdown bag. The punching bag 26 could be connected to a reflex arm 24 which is connected to the trampoline as described in the earlier figures. Again, the user would be connected to a virtual reality device 170. This would allow the user to interact with the user's desired situation. The user could program the difficulty level including the desired level whether fighting a professional boxer or an amateur.

Figure 14:
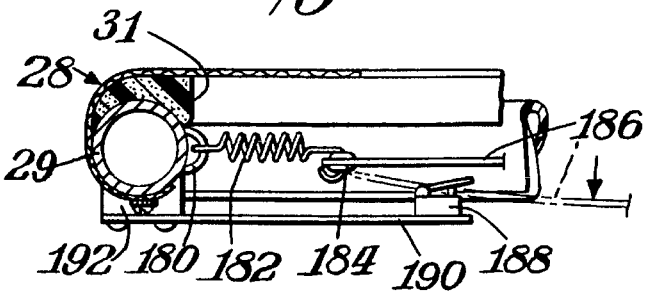
FIG. 14 illustrates a cross-sectional elevational view of a further embodiment of this invention.

FIG. 14 shows a cross-sectional elevational view of a construction of a trampoline frame and microswitch to sense trampoline surface movement and to program musical tunes or notes. FIG. 14 shows the rebounding surface 186 being that of a trampoline. A mounting block 192 could be mounted to the trampoline frame 28. A spring arm 190 could be connected to the mounting block 192. The microswitch 188 could be connected to the spring arm 190. The trampoline surface 186 would be depressed when the user steps on or bounces on the surface 186. The surface 186 could come in contact with the microswitch 188, when the user steps on or jumps on the surface 186. The surface 186 could depress the microswitch 188 and when the trampoline springs back, the trampoline surface returns to its original position, and the microswitch 188 would return back to its original position. Each time the microswitch 188 is depressed, a musical note or song can be played. Depending upon how quickly the user steps on or bounces on the trampoline surface 186, would depend how quickly the microswitch 188 is depressed and how fast or slow the music or notes are played. The microswitch could be hooked up to any conventional musical device such as a musical box that has a pre-programmed song in it. The microswitch could also be set up to a horn, bell, or alarm and every time the microswitch 188 is depressed a noise can be sounded.

The trampoline surface 186 could contain a grommet 184. The grommet 184 could be near the outer end of the trampoline surface 186. The grommet 184 could go completely through the trampoline surface 186. A spring 182 having two ends can have one end inserted in the grommet 184 and have the opposite end inserted into a fastening means such as a D-ring 180. The D-ring 180 could be attached to the mounting block 192. The D-ring 180 could also be attached to the trampoline frame 28. The D-ring 180 could also be attached to the top of one of the legs 29. Also shown in FIG. 14 is the padding 31 on top of the trampoline frame 28.

Figure 15:
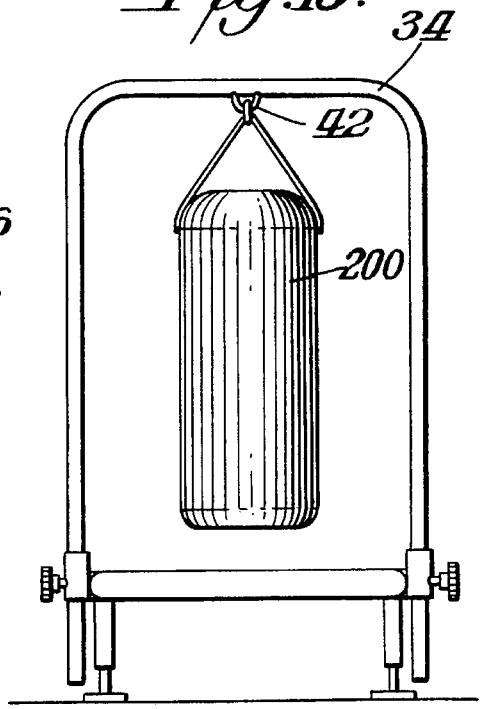
FIG. 15 illustrates a front elevational view of a further embodiment of this invention.

FIG. 15 shows a front elevational view of the modified combination punching bag and rebounding device. FIG. 15 shows a device that is similar to that described in FIG. 4 above. In FIG. 15, a heavy bag 200 is attached to a fastening means 42 such as a D-ring 42. The D-ring 42 could be attached to a frame 34. The frame 34 and the fastening means 42 have been discussed in FIGS. 4 and 5 above. The heavy bag 200 would allow a user to exercise a different type of upper body exercise. The user would hit the heavy bag 200 with the user's hands.

Figure 16:
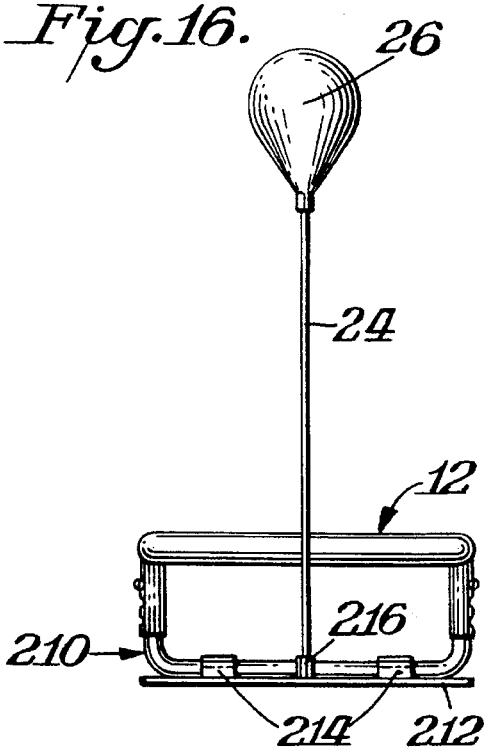
FIG. 16 illustrates a front elevational view of a further embodiment of this invention.
Figure 17:
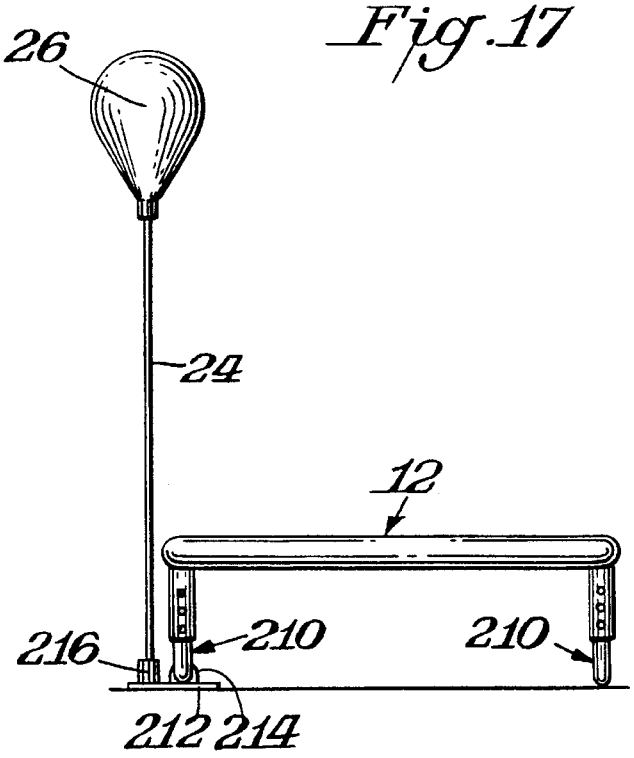
FIG. 17 illustrates a side elevational view of the embodiment shown in FIG. 16.

FIG. 16 shows a front elevational view of the combination punching bag and rebounding device that are interrelated. FIG. 17 shows a side elevational view of the combination punching bag and rebounding device of FIG. 16. In FIG. 16 the rebounding device shown is a trampoline 12. The trampoline 12 has two legs 210. The legs 210 can be interrelated to the punching bag device. The punching bag 26 could have a reflex arm 24 as described in the earlier figures. The reflex arm 24 could be connected to a base sprocket 216. The base sprocket 216 could be connected to a base 212 of a punching bag. The base 212 could be of any size or shape. The base 212 could add stability for the punching bag 26. The punching bag 26 can be used by itself and the base would prevent the punching bag from falling over when the user hits the punching bag 26. The base 212 of the punching bag can have a means for attaching 214 the rebounding device. It is possible that the means for attaching 214 the rebounding device such as a trampoline 12 could be by a locking means 214 as shown in FIGS. 16 and 17. The legs 210 of the trampoline can be pushed down into the locking means 214 until the legs 210 snap into position. The diameter of the opening in the locking means 214 could be smaller than the diameter of the legs 210. The force of the legs 210 would open the diameter of the locking means 214 thereby forcing the locking means 214 to lock the legs 210 into position. It is also possible that the locking means can be a hole inside the base that would allow the leg 210 to fit inside the hole. The hole could be slightly larger in diameter or the same diameter or even of a slightly smaller diameter than the base of the legs 210 thereby forcing the legs to fit into place. The base 212 can be long enough to cover all the legs 210. It is possible that instead of two legs being used, four legs are used and that there are four locking means 212, one for each of the legs.

The invention also relates to a method of exercising comprising using the exercise device as described above. The user may jump on the rebounding device with his legs and may either punch the punching bag with his hands or kick the punching bag with his legs. The rebounding device as described above can be, and is not limited to a trampoline or spring board. The user can get the desired workout from using the device as described above.

While there is shown and described herein certain specific structure embodying the invention, it will be manifest to those skilled in the art that various modifications and rearrangements of the parts maybe made without departing from the spirit and scope of the underlying inventive concept and that the same is not limited to the particular forms herein shown and described. The term punching bag with respect to the embodiments described in all the figures can interchangeably be a speed bag, heavy bag, etc.

What I claim:

1. An exercise device comprising a rebounding device and a punching bag wherein said punching bag is interfaced with said rebounding device wherein said rebounding device comprises:

a frame or a base, a rebounding surface attached to said frame or said base, a sleeve that is attached to said frame or said base, a reflex arm or an additional frame is attached to said sleeve and at least two cords having one of each and attached to said reflex arm or said additional frame and the opposite end of each cord being attached to said punching bag at least two cords having one end each attached to said reflex arm or additional frame and the opposite ends of each of said cords being attached to said punching bag at spaced locations and wherein said punching bag extends above the rebounding device such that when a user jumps on said rebounding device, the user can hit said punching bag with the user's hands.

2. The device as claimed in claim 1, wherein said rebound device is a trampoline or a spring board.

3. The device as claimed in claim 1, wherein said punching bag is connected to one end of a reflex arm and the other end of the reflex arm is attached to said rebound device.

4. The device as claimed in claim 2, wherein said rebound device is an adjustable trampoline, wherein the trampoline has a frame and at least two legs which have a bottom surface which is in contact with the ground and said legs are adjustable in height and the trampoline has a rebounding surface which is above said ground surface.

5. The device as claimed in claim 4, further comprising at least one non-slip foot wherein said foot is attached to the bottom surface of said leg.

6. The device as claimed in claim 4, further comprising a movable sleeve and a trampoline that has a frame which contains a rebounding surface wherein said sleeve is attached to said frame and can be positioned on the frame wherever the user desires it.

7. The device as claimed in claim 6, further comprising padding that is attached to said frame in order to prevent injury to a user while using said trampoline, and wherein said padding is made from a resilient material.

8. The device as claimed in claim 2, wherein said rebound device is a trampoline wherein said trampoline contains four legs which are adjustable in height and the trampoline has a rebound surface which is above the ground surface and the trampoline further comprises an inverted U-shaped frame mounted to said trampoline above said rebounding surface wherein said punching bag is connected to the top of said U-shaped frame.

9. The device as claimed in claim 8, further comprising at least four fastening means attached to different positions of said U-shaped frame wherein there are four cords having one end attached to the fastening means and having one end attached to the punching bag.

10. The device as claimed in claim 3, further comprising an electronics package display connected to said device.

11. The device as claimed in claim 2, wherein said rebound device is a trampoline wherein said trampoline contains three or more legs which are adjustable in height and said trampoline has a rebound surface which is above the ground surface and the trampoline further comprises a frame mounted to said trampoline above said rebounding surface.

12. The device of claim 11, wherein said at least two cords are connected horizontally to opposite ends of said frame.

* * * * *